United States Patent [19]

Nagatsuka

[11] 4,437,202

[45] Mar. 20, 1984

[54] AUTOMATIC WALL CLEANING MACHINE

[75] Inventor: Kenichi Nagatsuka, Tokyo, Japan

[73] Assignees: Mitsubishi Kakoki Kaisha Ltd.; Kakoki Engineering Service Co., Ltd.; Genshi-Ryoku Daiko Co., Ltd., all of Tokyo, Japan

[21] Appl. No.: 291,916

[22] Filed: Aug. 11, 1981

[51] Int. Cl.[3] ..... A47L 11/202

[52] U.S. Cl. ..... 15/320; 15/415 R

[58] Field of Search ..... 15/302, 415 R, 345, 15/346, 320, 321, 322, 419, 420, 421

[56] References Cited

U.S. PATENT DOCUMENTS

| | | | |
|---|---|---|---|
| 564,013 | 7/1896 | Furnas | 15/346 X |
| 1,752,664 | 4/1930 | Forcier | 15/419 X |
| 1,821,715 | 9/1931 | Kuchinsky | 15/322 |
| 3,344,454 | 10/1967 | Mikalson | 15/50 C |
| 3,512,206 | 5/1970 | Young | 15/346 |
| 3,605,171 | 9/1971 | Candor et al. | 15/322 X |
| 3,719,966 | 3/1973 | Lamont | 15/420 X |
| 4,025,984 | 5/1977 | Hoener | 15/302 |
| 4,193,156 | 3/1980 | Chauvier | 15/420 X |

*Primary Examiner*—Chris K. Moore

*Attorney, Agent, or Firm*—Oblon, Fisher, Spivak, McClelland & Maier

[57] ABSTRACT

An automatic wall cleaning machine includes a suction device having plural elastic suction leaves having a trapezoidal plane view and a tapered shaped sectional view which are mounted on a peripheral part of a disc so as to contact adjacent side surfaces of said suction leaves; a suction pipe and a blower for forming a vacuum space surrounded by said disc, said suction leaves and a part of a wall; and a rotary brush with a water sprayer.

8 Claims, 5 Drawing Figures

AUTOMATIC WALL CLEANING MACHINE

BACKGROUND OF THE INVENTION

1. Field of the Invention

The present invention relates to an automatic wall cleaning machine used for cleaning a wall of a pit such as a large scale stainless steel pit in a nuclear power plant.

2. Description of the Prior Art

An operation for cleaning the large scale stainless pit has been manually carried out. In the manual operation, a scaffolding has been set up or a gondola elevator has been used in the pit. Thus, the operation is remarkably unstable because of the repulsive force applied in the cleaning operation whereby it requires a long operation period. Moreover, this is a dangerous operation and accordingly, it has been difficult to attain a satisfactory cleaning operation.

SUMMARY OF THE INVENTION

It is an object of the present invention to provide an automatic wall cleaning machine which can operate for a cleaning of all walls under uniform force by shifting the cleaning device along the wall under a vacuum on the wall against a dead weight and a repulsive force applied by a cleaning brush.

The foregoing and other objects of the present invention have been attained by providing an automatic wall cleaning machine which comprises a suction device having plural elastic suction leaves having a trapezoidal plane view and a tapered shaped sectional view which are mounted on a peripheral part of a disc so as to contact adjacent side surfaces of said suction leaves; a suction pipe and a blower for forming a vacuum space surrounded by said disc; said suction leaves and a part of a wall; and a rotary brush with a water sprayer. The elastic suction leaf has a bent tapered sectional view with a ⟌ or ⟍⟌ shape and a wall contact edge which has a curved sectional view. The elastic suction leaves are preferably fixed on a disc to form a flat head cone.

DETAILED DESCRIPTION OF THE PREFERRED EMBODIMENTS

Figure 1:
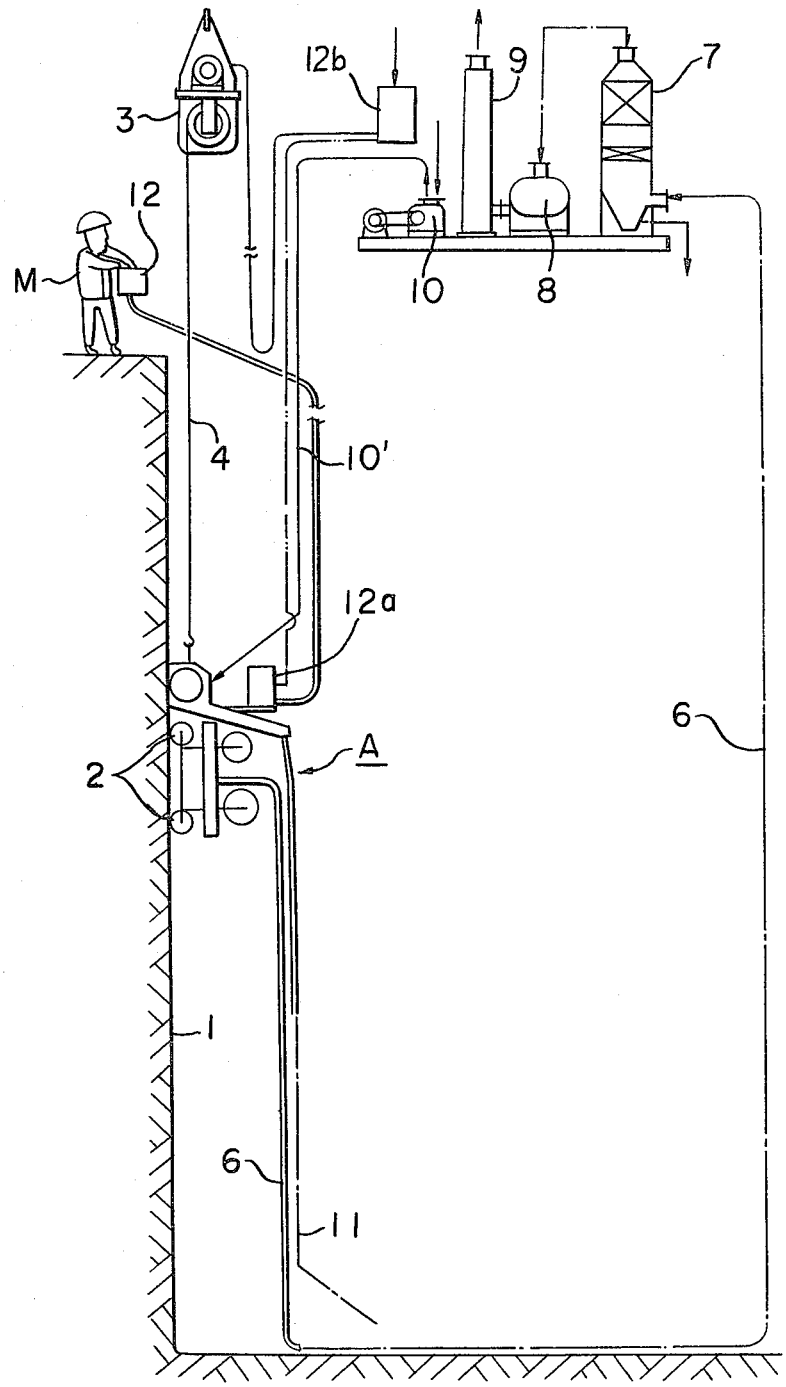
FIG. 1 is a schematic view showing an operation for cleaning a wall of a pit by an automatic wall cleaning machine of the present invention.

Referring to the drawings, one embodiment of the present invention will be illustrated.

FIG. 1 shows the remote control operation for cleaning a wall (1) of a pit by the automatic wall cleaning machine (A) of the present invention operated by an operator (M). The wall cleaning machine (A) moves up and down on the stainless steel wall (1) by four wheels (2), (2*a*). A winch (3) is suspended by a crane (not shown) and a rope (4) is wound up and released in synchronization with the wall cleaning machine (A) so as to maintain safety.

The wall cleaning machine (A) has a sucking device having the following special structure so as to move on the wall under suction in vacuum on the wall. A suction pipe (6) is connected to the suction device (5) and a blower (8). A tower (7) has a demister and a filter, and a silencer (9) is connected to the delivery of the blower (8). A plunger pump (10) feeds compressed water through a feed pipe (10') to a rotary brush (23) for cleaning with the wall cleaning machine. The rotary brush for cleaning sprays water on the wall (1) during the rotation of the brush and the brush is covered by a hood so as to prevent the scattering of waste water and the waste water is discharged through a drain pipe (11). The wall cleaning machine is remote-controlled by the operator (M) with a control panel (12) through an auxiliary control panel (12*a*) which is connected to a main control panel (12*b*).

Figure 2:
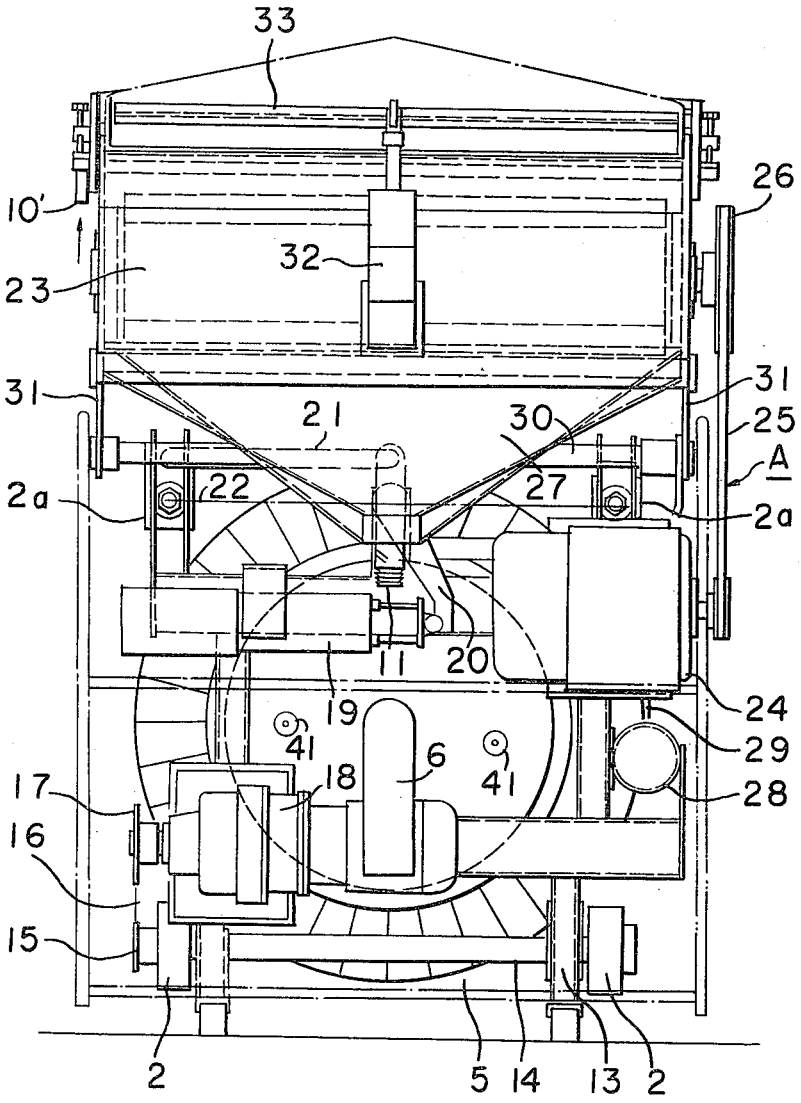
FIG. 2 is a front view of the automatic wall cleaning machine of the present invention.
Figure 3:
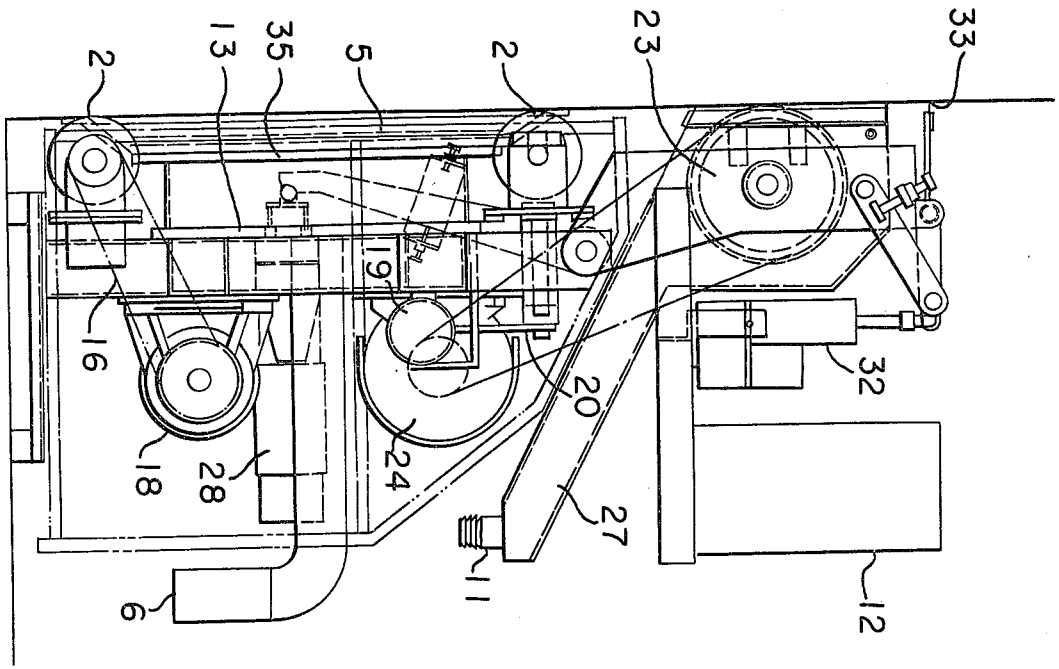
FIG. 3 is a left side view of the machine shown in FIG. 2.

Referring to FIGS. 2 and 3, the reference (13) designates a frame for the wall cleaning machine (A). The lower wheels (2) are driving wheels fixed on a shaft (14) supported by the frame (13) and are driven by a geared motor (18) through a sprocket (15), a chain (16) and a sprocket (17).

On the other hand, the upper wheels (2*a*) can change direction by a power cylinder (19) through a lever (20) and a steering rod (21). The right wheel (2*a*) is simultaneously operated with the left wheel by a coupling rod (22). A cleaning rotary brush (23) is used by spraying water fed through a water pipe (10') on the wall (1) to clean the wall. The cleaning rotary brush (23) is driven by a motor (24), a belt (25) and a pulley (26). A hood (27) is provided to cover the cleaning rotary brush (23) to prevent the scattering of the sprayed water and the drain pipe (11) is connected to the lower central part. The cleaning rotary brush (23) can follow a wall curve by use of a power cylinder (28) and a link mechanism (29), (30), (31) and a power cylinder (32) can swing a sweeper (33) for water removal.

Figure 4:
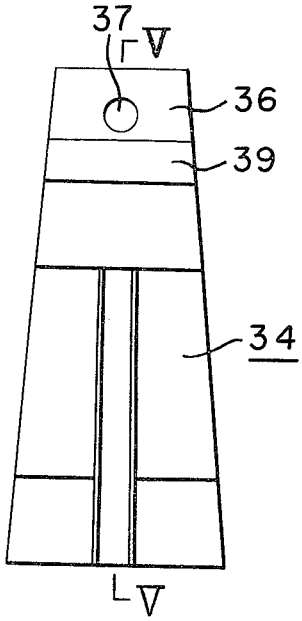
FIG. 4 is a plane view of a suction leaf.
Figure 5:
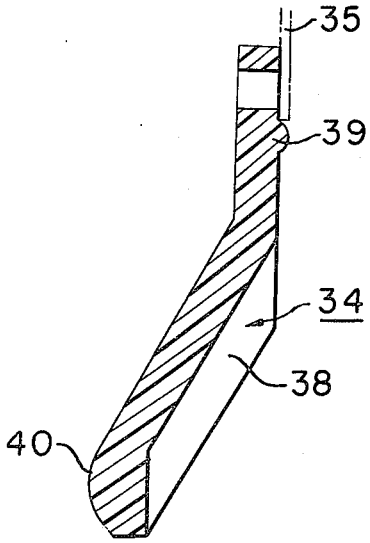
FIG. 5 is a sectional view taken along the line of V—V of FIG. 4.

Referring to FIGS. 4 and 5, the suction device (5) has thirty six elastic suction leaves (34) which are mounted on a peripheral part of a disc (35). The suction leaves (34) can be prepared by molding an elastic material such as polyurethane.

The adjacent side surfaces of the suction leaves are brought into contact whereby the space surrounded by the suction leaves (34), the disc (35) and the stainless steel wall (1) can be kept in vacuum by the suction.

As shown in FIG. 4, the suction leaves (34) respectively have each bolt hole (37) at each fitting part (36). Each suction leaf has a trapezoidal plane view having broader width at the periphery and has a ⟍ shaped sectional view as shown in FIG. 5. A reinforcing rib (38) and a positioning rib (39) are formed at the fitting part (36). The contacting surface of periphery (40) of the suction leaf (34) is formed in an arc so as to easily maintain the air-tightness by contacting with the wall (1).

In FIG. 2, an automatic control valve (41) is provided for a constant vacuum pressure so as to maintain a desired degree of vacuum in the space surrounded by the suction leaves (34).

The wall cleaning machine (A) having the aforementioned structure can be used without setting a scaffolding or riding on an unstable gondola. It is possible to operate in remote-control by an operator at a safe position outside of the pit and to attain a speedy operation.

The wall cleaning machine (A) moves on the wall under the vacuum suction whereby the cleaning operation is performed under a uniform force applied by the cleaning brush.

The driving device for the wall cleaning device can change the direction for moving whereby it is possible to move it in any direction past an obstacle on the wall.

The sucking device is formed by using many elastic suction leaves whereby there is no vacuum leakage. Even though there may be a small uneven part on the wall, the suction leaves are partially bent to result in buffer and the cleaning operation can be smoothly performed.

In the aforementioned description, the automatic wall cleaning machine of the present invention is used for cleaning the pit in a nuclear power plant. This is not critical. Thus, the automatic wall cleaning machine of the present invention can be used for cleaning a wall of any large tank. The machine can be also used for removing rust on a wall by using a grinder instead of a cleaning brush.

What is claimed as new and desired to be secured by Letters Patent of the United States is:

1. In an automatic wall cleaning machine having wall cleaning means, means for moving said wall cleaning machine along said wall, and a suction device for biasing said wall cleaning machine towards a wall, said suction device comprising:

a disk connected to said machine;

suction producing means;

a suction conduit communicating one side of said disk with said suction producing means; and a plurality of trapezoidal elastic suction leaves connected to the periphery of said disk, each of said leaves having a first relatively narrow end connected to the periphery of said disk, a second relatively wide end longitudinally opposite said first end and side walls connecting said ends, wherein said side walls of adjacent ones of said leaves contact one another, wherein said second ends of said leaves lie in a plane spaced from said disk, whereby said one side of said disk, said leaves and said wall define a vacuum space when said machine is positioned adjacent said wall.

2. The device of claim 1 wherein each of said leaves is bent so that said second end extends out of the plane of said disk and toward said wall when said machine is positioned adjacent said wall.

3. The device of claim 1 wherein each of said second ends of said leaves has a wall contacting edge which is curved in a longutidinal section of each said leaf.

4. The device of claim 1 wherein each of said leaves includes a longitudinally extending reinforcing rib.

5. An automatic wall cleaning machine comprising:

a frame including means for spacing said frame from a wall;

a rotary brush rotatable about an axis fixed to said frame;

a water sprayer fixed to said frame; and a suction device fixed to said frame, said suction device comprising:

(a) a disk, (b) suction producing means, (c) a suction conduit communicating one side of said disk with said suction producing means, and (d) a plurality of trapezoidal elastic suction leaves connected to the periphery of said disk, each of said leaves having a first relatively narrow end connected to the periphery of said disk, a second relatively wide end longitudinally opposite said first end and side walls connecting said ends, wherein said side walls of adjacent ones of said leaves contact one another, wherein said second ends of said leaves lie in a plane spaced from said disk, whereby said one side of said disk, said leaves and said wall define a vacuum space when said machine is positioned adjacent said wall.

6. The machine of claim 5 wherein each of said leaves is bent so that said second end extends out of the plane of said disk and toward said wall when said machine is positioned adjacent said wall.

7. The device of claim 5 wherein each of said second ends of said leaves has a wall contacting edge wich is curved in a longitudinal section of each said leaf.

8. The machine of claim 5 including:

a longitudinally extending reinforcing rib on each of said leaves;

drive means for moving said frame; and remote control means for changing the direction of movement of said machine.

* * * * *